United States Patent [19]

Stieger

[11] 4,349,312

[45] Sep. 14, 1982

[54] APPARATUS FOR THE CONTROLLED EXTRACTION OF STEAM FROM EXTRACTION TURBINES

[75] Inventor: Karl Stieger, Turgi, Switzerland

[73] Assignee: BBC Brown, Boveri & Company, Ltd., Baden, Switzerland

[21] Appl. No.: 136,348

[22] Filed: Apr. 1, 1980

[30] Foreign Application Priority Data

Jul. 12, 1979 [CH] Switzerland ..... 6496/79

[51] Int. Cl.[3] ..... F01D 17/00

[52] U.S. Cl. ..... 415/145; 415/157

[58] Field of Search ..... 415/144, 145, 157, 153 R, 415/153 A; 60/39.15

[56] References Cited

U.S. PATENT DOCUMENTS 4,245,467 1/1981 Shank, Jr. et al. ..... 60/39.15

*Primary Examiner*—Louis J. Casaregola
*Assistant Examiner*—Jeffrey A. Simenauer
*Attorney, Agent, or Firm*—Burns, Doane, Swecker & Mathis

[57] ABSTRACT

An apparatus adjustably extracts steam from extraction turbine. The apparatus includes a regulating drum which concentrically surrounds the turbine shaft and is mounted for axial movement toward away from a portion of the turbine shaft to form therewith an annular throttle gap which is variable between minimum and maximum values in response to axial movement of the drum, to control the steam flow that is being extracted.

2 Claims, 3 Drawing Figures

APPARATUS FOR THE CONTROLLED EXTRACTION OF STEAM FROM EXTRACTION TURBINES

BACKGROUND AND OBJECTS OF THE INVENTION

The present invention concerns an apparatus for the controlled extraction of steam from extraction turbines.

Volume flows are extracted for heating or operational purposes from any stage of extraction turbines. The flow of steam to be extracted can be influenced either by an external or an internal control.

The external control is accomplised by a throttle element that is placed within the extraction line. A flow of steam, in functional relation to the rate of throttling set by the throttling element, always passes through the turbine section located behind the point of extraction. The amount of steam flowing through this turbine section can therefore not be reduced to any quantity desired if this type of control is being employed.

This disadvantage is overcome by an internal control which makes it possible to vary the flow of steam which remains in the turbine behind the point of extraction between zero and 100 percent. In practice, the minimum value of the flow of steam behind the point of extraction will equal the flow of cooling steam which is required for the cooling of the remaining blades. In known systems of the internal control type, the point of steam extraction is separated from the down-stream turbine section by an intermediate wall which is sealed against the turbine housing and shaft. Steam is bled by way of several valves, placed on the housing exterior, into a duct which passes through the intermediate wall, thus reaching a point downstream of the point of extraction in a more or less throttled state. The rate of throttling by the valves thus determines the rate of steam flow into the extraction line. This design of an internal control requires a great amount of space in the axial direction due to the valves, the intermediate wall and the rerouting of the duct in the down-stream direction behind the intermediate wall.

In accordance with this great over-all axial length, the bearing span of the turbine shaft must also be great with the resultant danger of too low critical shaft speeds. The sealing of the intermediate wall against the turbine shaft also poses problems. Another disadvantage, occurring during operation, is the danger of housing deformations due to nonuniform heating resulting (for reasons based on manufacturing, design and proper operation) from the set of valves being arranged at the top of the housing, thus unbalancing its rotary symmetry. Finally, the steam flow through the set of valves and the duct is very undesirable from a flow-engineering standpoint.

It is an object of the invention to establish an internal control system for the extraction of steam from extraction turbines which will avoid the above-discussed disadvantages of the known arrangements.

SUMMARY OF THE INVENTION

This object is achieved by the present invention which involves a regulating drum which concentrically surrounds a turbine shaft and is mounted for axial movement toward and away from a portion of the turbine shaft to form therewith an annular throttle gap which is variable between minimum and maximum values in response to axial movement of the drum, to control the steam flow that is being extracted.

THE DRAWING

The invention is described below in detail with reference to the practical example thereof illustrated in the drawing wherein:

FIGS. 1 and 2 each show in longitudinal section those components of the steam extraction apparatus located above the axis of the turbine shaft, with FIG. 1 depicting the apparatus in a minumum extraction position, and FIG. 2 depicting the apparatus in a fully opened state, and FIG. 3 shows a cross-section of the apparatus taken along line 3—3 in FIG. 2.

DETAILED DESCRIPTION OF A PREFERRED EMBODIMENT

Figure 1:
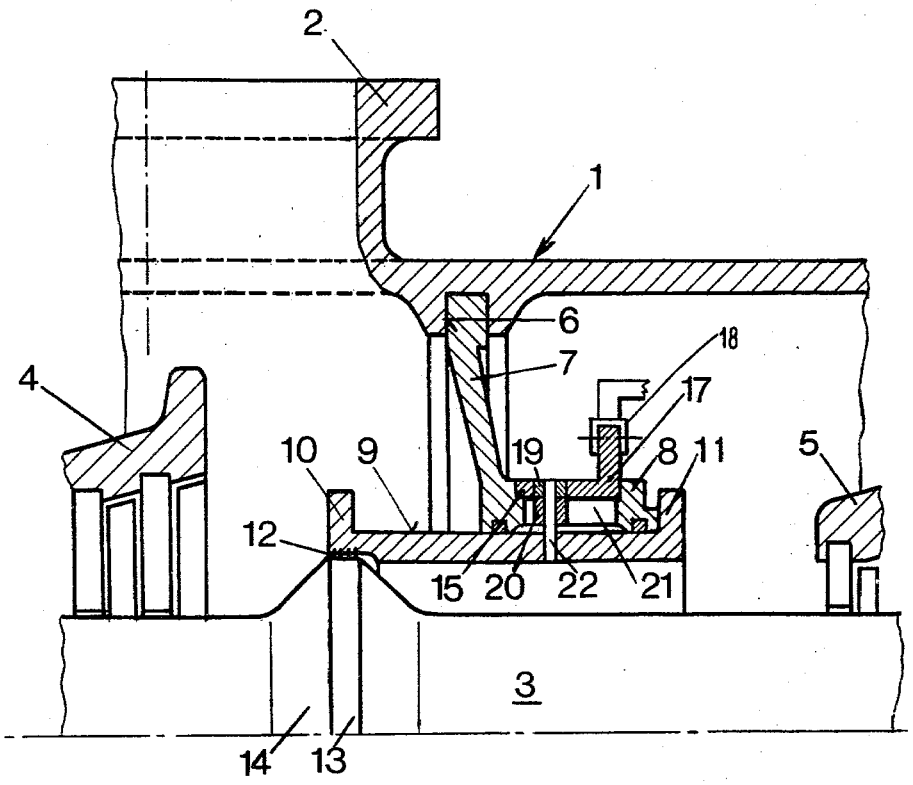
Figure 2:
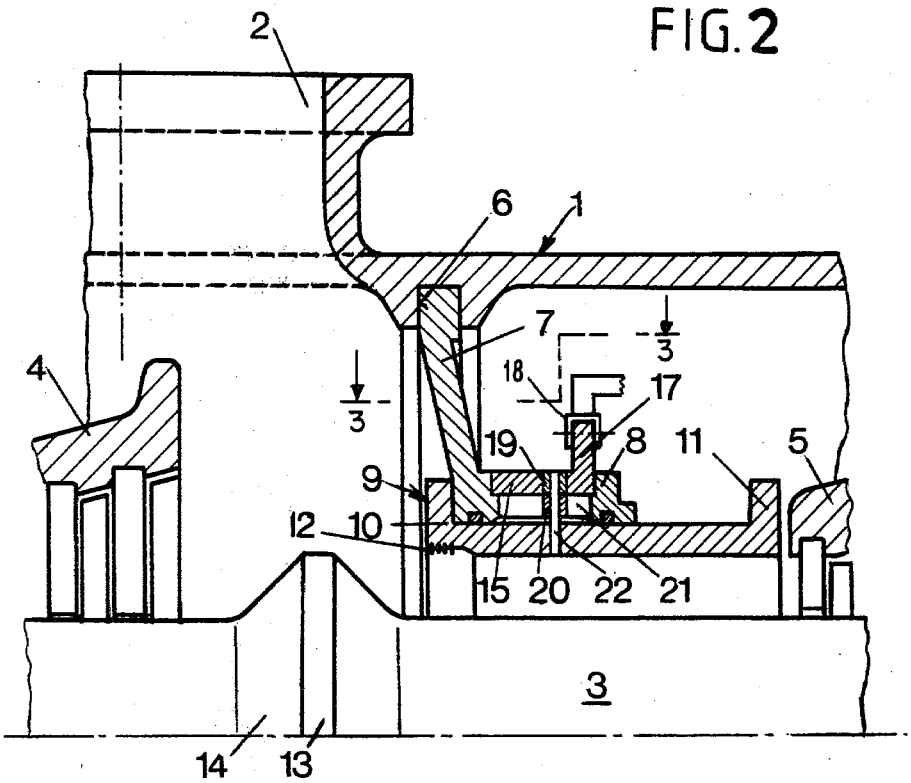

In FIGS. 1 and 2 are depicted the turbine housing 1 and the branch 2 for an extraction pipe (not shown). Disposed in the housing are the turbine shaft 3 and the vane carrier 4 of a high-pressure section. One portion of a vane carrier 5 of the low-pressure section, which follows in direction of flow, is visible in these figures at the right.

Between the high and low-pressure sections there is located within the housing 1, in known manner by means of an annular groove 6, an intermediate wall 7. The intermediate wall 7 is provided with a boss 8 and a bore to accommodate a regulating drum 9. This drum is axially movable within the bore of boss 8 but mounted in such manner that it is prevented from rotating. The drum carries two end flanges 10 and 11 which, at its extreme positions of axial movement abut the sides of the boss 8, thus limiting the length of the axial movements.

Inwardly from the end flange 10 at the left, there is located within a bore of the regulating drum 9 a labyrinth seal 12 which in its terminal position at the left opposite a cylindrical area 13 of the turbine shaft, will fit against a collar 14 of the turbine shaft 3 which includes such cylindrical area 13. Preferably, there is a clearance between the labyrinth seal 12 and the cylindrical area 13 of the turbine shaft dimensioned so that in practice a throttle gap is formed when the drum is in the closed position (as depicted in FIG. 1) to permit a limited flow of steam (so-called cooling steam) to the low-pressure side of the turbine as is required for the cooling of the idling low-pressure blade system. In the fully open position (illustrated in FIG. 2), as well as in all intermediate positions, the regulating drum 9 and collar 14 of the turbine shaft together define a ring-shaped gap with an axially symmetrical flow, an arrangement which is very efficient from a flow-engineering aspect.

Figure 3:
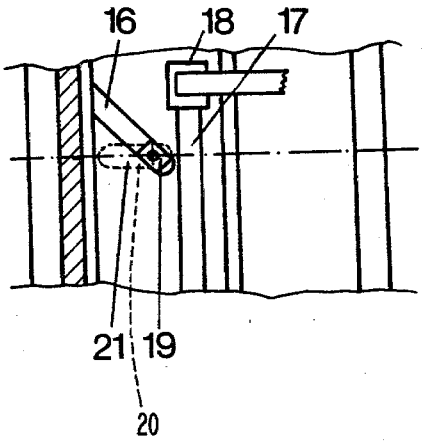

There will now be described a preferred mechanism for axially shifting the drum 9. At the perimeter of the boss 8 of the intermediate wall 7, a guide ring 15 is mounted for rotation and secured against axial motion. The guide ring 15 has a helical guide slot 16 (see FIG. 3) as well as an adjusting arm 17 to which is connected a suitable actuating linkage. A suitable linkage comprises a fork 18 of a forked rod which is preferably displaced by a mechanical, mechanical-hydraulic or completely hydraulic adjusting mechanism to rotate the guide ring 15. This rotational motion is converted to an axial movement of the regulating drum 9 by the helical slot 16 which is engaged by a slide block 19. A second slide block 20 is slidable in a straight guide slot 21 of the boss 8 to prevent the drum 9 from turning during its axial movement. Both blocks 19, 20 are rotatably mounted on a pin 22 which is fixedly mounted on the casing of the drum 9.

As noted earlier, in the fully open position (FIG. 2) or intermediate positions, the ring-shaped duct defined by the drum 9 and collar 14 provides an axially symmetrical flow. As a result, the housing can be designed practically axially symmetrical within this region, resulting in a uniform thermal expansion throughout the entire housing contour, thus eliminating any warping of the housing. Furthermore, the overall length will be substantially reduced when compared with the prior art design wherein valves are placed onto the housing. As a result of this and the simplified layout, considerable cost savings are realized. This novel design also makes possible a reduction in the bearing span of the shaft so that the shaft will become, without change in diameter, more rigid than the shafts of the prior art designs, thereby raising the critical shaft speeds; it is also possible to reduce the weight of the shaft, retaining the original critical shaft speeds.

The novel design has finally the advantage that sealing problems will not arise at the point of passage of the shaft through the bore of the regulating drum.

Although the invention has been described in connection with a preferred embodiment thereof, it will be appreciated by those skilled in the art that additions, deletions, substitutions, and modifications not specifically described may be made without departing from the scope of the invention as defined in the appended claims.

What is claimed is:

1. In a turbine comprising a housing, a turbine shaft, a turbine blade channel, and apparatus for controlled extraction of steam from one stage of the blade channel, the improvement wherein said apparatus comprises:

a wall mounted within said turbine housing and including first and second axially spaced stops, a regulating drum surrounding said turbine shaft concentrically and spaced therefrom to define therewith a steam passage, said drum including first and second flanges and being axially movable to shift said flanges with said stops which define first and second positions of said drum, said drum including sealing means at a steam entry end of said passage cooperating with a cylindrical portion of said shaft to form therewith a throttle gap, the size of said gap varying from a minimum to a maximum in response to axial movement of said drum from said first position, and actuating means for moving said regulating drum to vary the size of said gap and thereby control the amount of steam passing therethrough.

2. In a turbine comprising a housing, a turbine shaft, a turbine blade channel, and apparatus for controlled extraction of steam from one stage of the blade channel, the improvement wherein said apparatus comprises:

a wall mounted within said turbine housing and including first and second axially spaced stops, a regulating drum surrounding said turbine shaft concentrically and spaced therefrom to define therewith a steam passage, said drum being axially movable into contact with said stops which define first and second positions of said drum, said drum including sealing means at a steam entry end of said passage cooperating with a cylindrical portion of said shaft to form therewith a throttle gap, the size of said gap varying from a minimum to a maximum in response to axial movement of said drum from said first position, and acutating means for moving said regulating drum to vary the size of said gap and thereby control the amount of steam passing therethrough, said actuating means comprising a guide ring rotatably mounted on a boss of said base, said guide ring including a helical guide slot, said boss including a straight slot, a pin projecting radially from said drum and disposed in both said slots, first and second slide blocks rotatably mounted on said pin and slidably movable in said helical and straight slots, respectively, and a rod connected to said guide ring for rotating the latter, whereby rotational movement of said guide ring is transmitted by said pin to said drum as axial movement of the latter.

* * * * *